US007381173B2

(12) United States Patent
Planke

(10) Patent No.: US 7,381,173 B2
(45) Date of Patent: Jun. 3, 2008

(54) TRAINING APPARATUS

(75) Inventor: Tore Planke, Tvedestrand (NO)

(73) Assignee: Nordisk Terapi AS, His (NO)

( * ) Notice: Subject to any disclaimer, the term of this patent is extended or adjusted under 35 U.S.C. 154(b) by 0 days.

(21) Appl. No.: 10/525,436

(22) PCT Filed: Aug. 27, 2003

(86) PCT No.: PCT/NO03/00299

§ 371 (c)(1),
(2), (4) Date: Jul. 25, 2005

(87) PCT Pub. No.: WO2004/020045

PCT Pub. Date: Mar. 11, 2004

(65) Prior Publication Data

US 2006/0128531 A1 Jun. 15, 2006

(30) Foreign Application Priority Data

Aug. 30, 2002 (NO) ..... 20024160

(51) Int. Cl.
*A63B 1/00* (2006.01)
*F16G 11/00* (2006.01)

(52) U.S. Cl. ..... 482/148; 482/38; 24/130

(58) Field of Classification Search ..... 482/24, 482/38–40, 143, 37, 43, 148; 182/5, 231; 5/83.1; 24/130
See application file for complete search history.

(56) References Cited

U.S. PATENT DOCUMENTS 723,231 A * 9/1903 Benedict ..... 254/391
1,105,624 A * 8/1914 Davis ..... 24/134 R
1,243,107 A * 10/1917 Richardson ..... 188/65.1
3,574,900 A * 4/1971 Emery ..... 24/130
3,807,696 A * 4/1974 Brda ..... 254/391
4,580,658 A * 4/1986 Brda ..... 182/5
4,765,005 A * 8/1988 Hippel ..... 5/648
5,024,433 A * 6/1991 Mosberg ..... 482/96
5,048,825 A * 9/1991 Kelly ..... 482/94
5,288,283 A 2/1994 Meeker
5,429,571 A * 7/1995 Smith et al. ..... 482/115
5,533,952 A 7/1996 Schaber
5,540,307 A * 7/1996 Pickering ..... 188/188
5,548,873 A * 8/1996 Macias ..... 24/134 R
5,556,369 A * 9/1996 Roberts ..... 482/131
5,634,873 A * 6/1997 Carlstrom ..... 482/95
5,664,640 A * 9/1997 Smith ..... 182/5
5,947,875 A * 9/1999 Cone et al. ..... 482/69

(Continued)

*Primary Examiner*—LoAn H. Thanh
*Assistant Examiner*—Allana Lewin
(74) *Attorney, Agent, or Firm*—Rodman & Rodman

(57) ABSTRACT

A training apparatus consisiting of a rope (2) which can be passed via a suspended direction reversal means (1), wherein a first part (2') of the rope is arranged to hang down from one side of the direction reversal means, wherein a handle loop (3) is provided at one end (2") of the first part (2') of the rope, and wherein a second part (2'") of the rope is arranged to hang down from another side of the direction reversal means and is designed to form releasable engagement with a locking device (4, 4') of the key way type, so-called "Cleat-lock". The locking device (4) is secured to the first part of the rope, and the direction reversal means (1) is selected from the group consisting of: a beam, a bar, a guide tube, a guide channel, a pulley and a suspension bracket.

13 Claims, 3 Drawing Sheets

U.S. PATENT DOCUMENTS 5,997,448 A 12/1999 Duba
6,163,936 A * 12/2000 Benoit ..... 24/130
6,234,454 B1 * 5/2001 Vassioukevitch ..... 254/391
6,505,384 B1 * 1/2003 Renton et al. ..... 24/134 R
6,705,974 B1 * 3/2004 Tardif ..... 482/39

* cited by examiner

TRAINING APPARATUS

The present invention relates to a training apparatus consisting of a rope that can be passed via a suspended direction reversal means, wherein a first part of the rope is arranged to hang down from one side of the direction reversal means, wherein a handle loop is provided at one end of the first part of the rope, and wherein a second part of the rope is arranged to hang down from another side of the direction reversal means and is designed to form releasable engagement with a locking device of the key way type, so-called "Cleatlock".

An apparatus of this kind is known from Norwegian Patent 161418. The known apparatus has two mutually independent ropes with respective direction reversal means, locking device and handle loop, and the direction reversal means are spaced apart at a fixed distance.

However, there has been a desire to find a training apparatus which is both cheaper to produce and easier to assemble in certain cases, and which permits the installation of just one rope and handle loop or two or more thereof, depending upon the need of the individual.

According to the invention, the apparatus mentioned above is characterised in that the locking device is attached to the first part of the rope, and that the direction reversal means is selected from the group consisting of: a beam, a bar, a guide tube, a guide channel, a pulley and a suspension bracket.

According to an another embodiment of the apparatus, wherein the direction reversal means is a suspension bracket, the bracket is made in the form of a U-shaped structure, and the arms of the U are hooked at their respective free ends. The distance between the arms of the U-shaped bracket may be adjustable, preferably for suspension from the upper door frame architraves of a door, and the arms may respectively have a perforated portion for the rope for the purpose of forming said direction reversal means.

According to one embodiment of the invention, the locking device is equipped with a retaining slot or clamp for the first part of the rope, and the locking device has in connection with the cleatlock part a guide, e.g., a guide belt or guide flap, which covers at least a portion of the opening of the key way part The purpose of the guide is to limit the movement of the rope out of the cleatlock, i.e., also transverse to the locking part, when the second part of the rope is manipulated to adjust the engagement of the key way with the rope. Advantageously, the guide is elastically yielding.

According to another embodiment, the cleatlock part of the locking device has at an upper end thereof a rope insertion groove for sideways insertion of the second part of the rope, and wherein said guide is designed to be positioned after insertion of the second part of the rope in order to limit the sideways movement of the rope part relative to the locking part of the locking device.

The invention will now be described in more detail with reference to the attached drawings.

Figure 2:
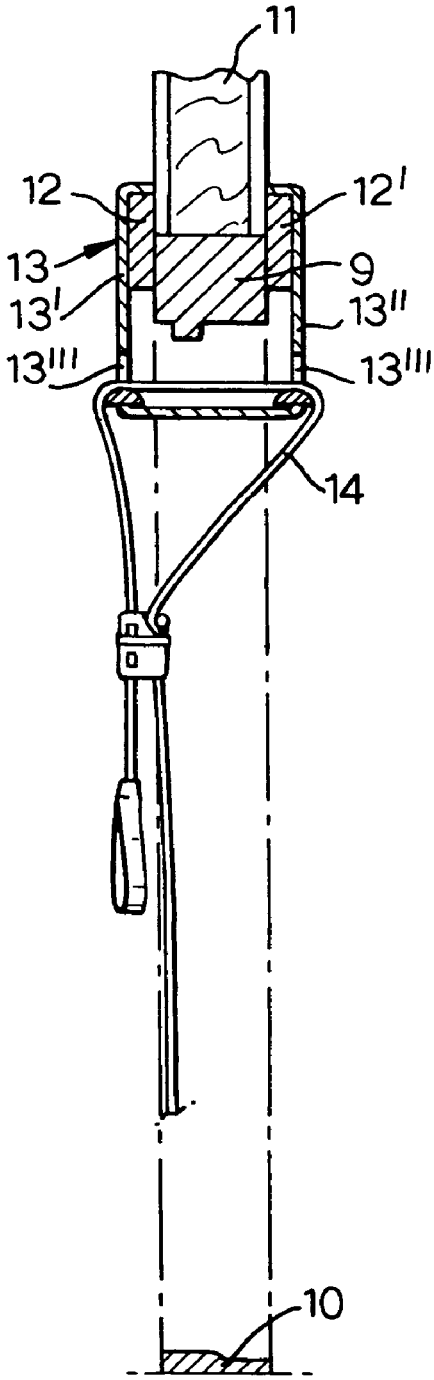
FIG. 2 shows a device in a second mode of use in cooperation with a suspension bracket.
Figure 3A:
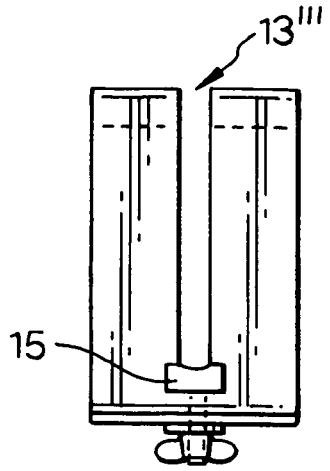
Figure 3B:
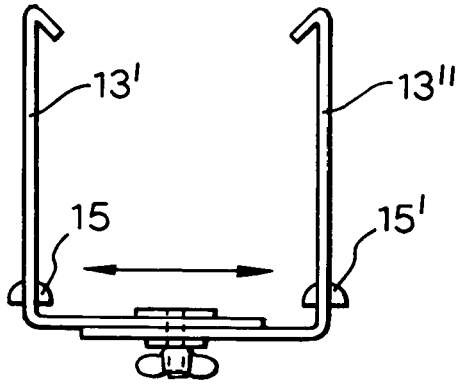

FIG. 3*a* and FIG. 3*b* show details of the suspension bracket as shown in FIG. 2.

Figure 4A:
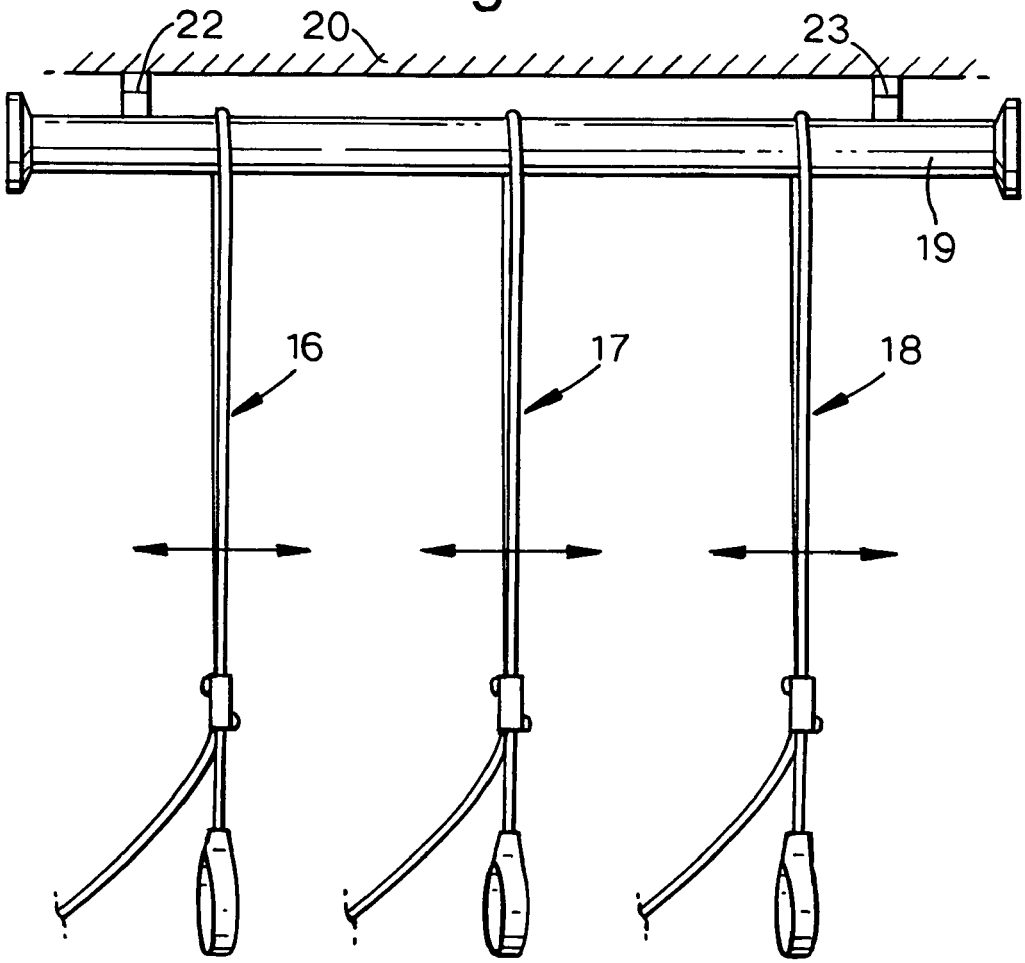
Figure 4B:
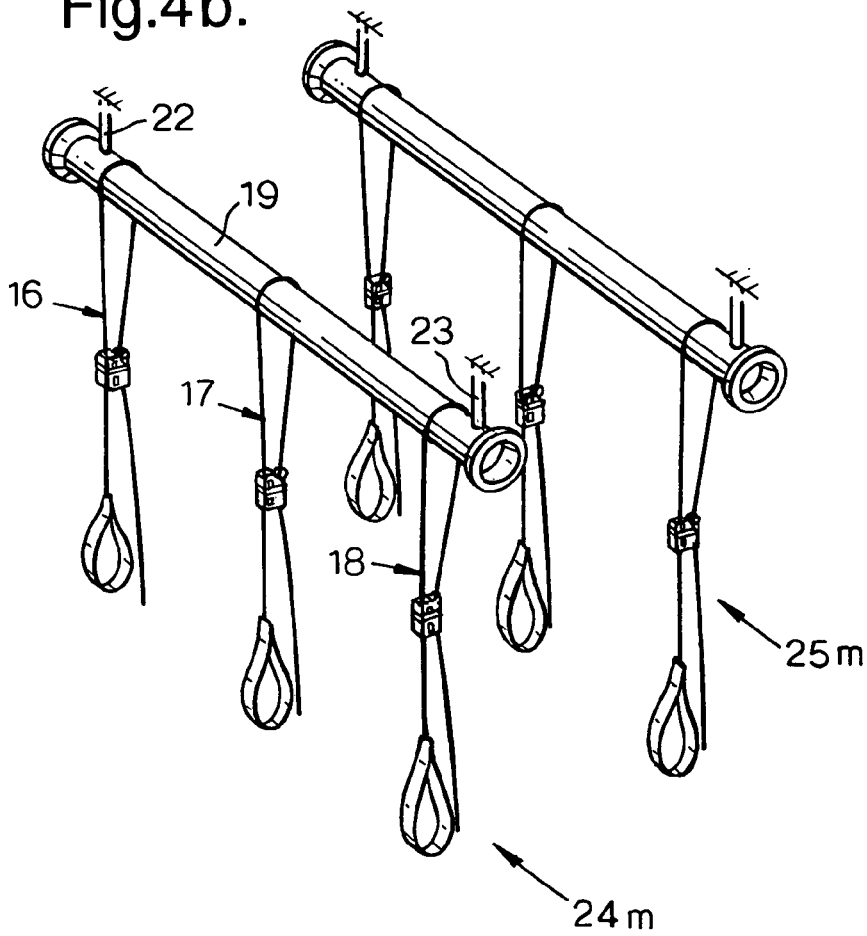

FIG. 4*a* shows a third mode of use of the apparatus, and FIG. 4*b* shows a variant use thereof.

Figure 5:
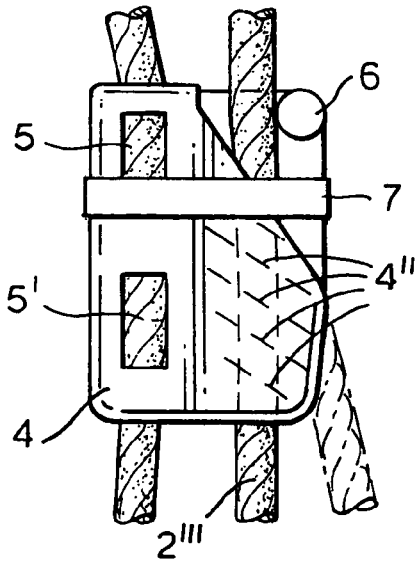

FIG. 5 shows details of the locking device that is an integral part of the apparatus.

Figure 6:
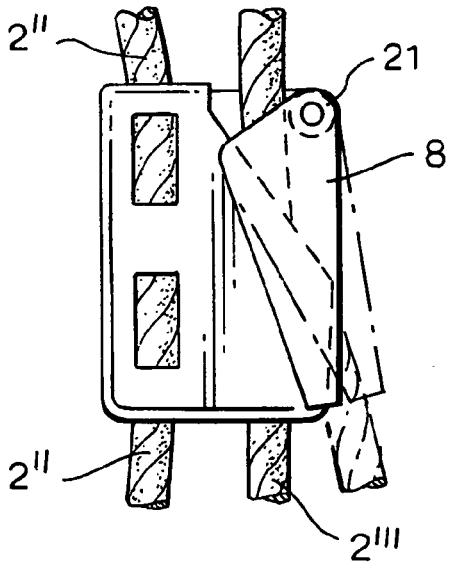

FIG. 6 shows a modification of the locking device according to FIG. 2.

Figure 1:
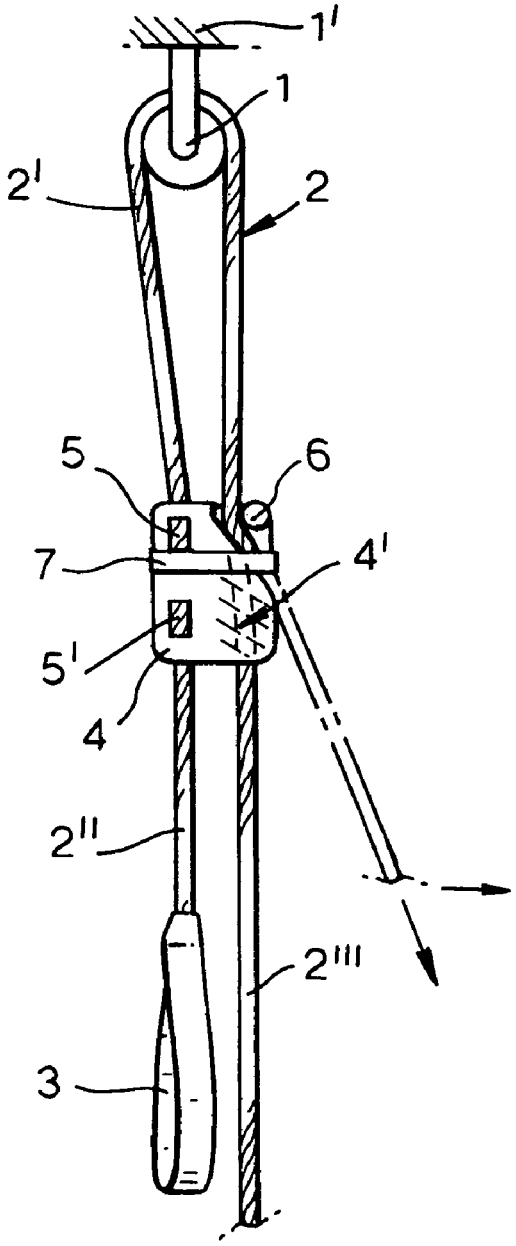
FIG. 1 shows an embodiment of the apparatus in a first mode of use according to the invention.

FIG. 1 shows a direction reversal means 1, e.g., a beam, bar, pulley or the like which is secured to a support 1', e.g., a frame structure or a building structure as for example a ceiling or door opening, over which is passed a rope 2 which in a first part 2' that hangs down on one side of the direction reversal means at one end 2" becomes a handle loop 3 and some distance above the handle loop is secured in a locking device 4, and which at the second end 2'" that hangs down on the other side of the direction reversal means is in releasable engagement with the locking part 4' of key way type (so-called "Cleatlock") on the locking device 4. The rope part 2' is attachable to the locking device by means of, e.g., retaining slots 5, 5', but can of course be attached by means of adhesive, clamps, rivets etc. Advantageously, there is on the locking device 4 above the locking part 4' a guide pin 6 for ensuring that the rope part 2'" cannot be easily pulled out of the locking part 4'. A guide, e.g., in the form of a guide belt 7, which can be elastically yieldable, or a guide flap 8, preferable outwardly pivotal against spring force, is intended to cover at least a part of the opening of the locking part 4', so that when the rope part 2'" is pulled out to the side for upward or downward adjustment of the loop 3, there is no risk of the rope part 2'" being pulled out so far that it exits the locking device 4.

When the rope part 2'" is released, it will slide inside the locking part 4' and be held by wedging there by the key way 4", see FIG. 5.

FIG. 2 shows how the apparatus according to the invention can be suspended from the upper door frame architraves of a door, and FIG. 3 shows the suspension bracket in more detail. In FIG. 2 the upper door frame member is indicated by the reference numeral 9, the door sill by the numeral 10, the wall structure by the numeral 11 and upper architraves (horizontal) by the numerals 12, 12'. The suspension fitting—or the bracket 13 consists, as shown in FIG. 3*a* and FIG. 3*b*, of two mutually movable parts 13', 13", each of which has an opening 13'" for insertion of the rope 14 (corresponding to the rope 2 in FIG. 1). A sliding guide 15, respectively 15' may be provided at the bottom of the opening. Alternatively, the sliding guide may be in the form of a roller or pulley (not shown). It is also possible that the suspension bracket, which has an approximate U-shape, may have arms which, e.g., can be bent away from each other in an elastically yielding manner so as to be able to grip the architraves by pure spring force.

FIG. 4*a* shows how, e.g., two or three units 16, 17, 18 consisting of rope with respective locking device and respective loop, according to the invention, can be suspended from a common direction reversal means 19, e.g., a bar, and where the direction reversal means is mounted on, e.g., a ceiling 20, via hooks 22, 23 which e.g., are spaced 60 cm or 120 cm apart.

Although three such units are shown, it would be possible to suspend more or fewer units according to need. Of course, it is also possible to have two parallel supports as shown in FIG. 4*b* with respectively m and n units for attached to respectively the units 24*m* and 25*n*, wherein m=1, 2, 3 . . . and n=1, 2, 3 . . . , and wherein m=n or m≠n. As shown, the rope will be passed around a part of the circumference of the beam or bar.

FIG. 5 shows that described in connection with FIG. 1 in more detail, and the difference between FIG. 5 and FIG. 6 is that FIG. 5 shows the guide belt 7, whilst in FIG. 6 this belt has been replaced by the guide flap 8. When the rope 2'" is to be passed into the locking part 4' of the locking device 4 for the first time, the belt will be held away from the locking device 4, but subsequently slipped into place thereon. When using the guide flap 8, the flap is turned (to the right in the figure) to the side and upwards about a pivot point 21 on the device 4, so that the rope 2''' may easily be placed inside the locking part, whereupon the flap is turned back to the position as shown. The flap 8 may be spring-loaded (not shown), but if the pivot mounting allows the flap to turn easily, spring-loading is not necessary, especially if the flap also has an adapted centre of gravity.

The invention claimed is:

1. A training apparatus consisting of a direction reversal means (1), suspendable from a fixed support and having two sides, a rope (2) which is passed via the suspended direction reversal means (1), a first part (2') of the rope being arranged to hang down from one side of the direction reversal means and having a lower end, a handle loop (2'') being provided at the lower end of the first part (2') of the rope, and a second part (2''') of the rope being arranged to hang down from the other side of the direction reversal means, wherein the apparatus has a rope locking device (4) with two opposite sides, one of said sides having a rope receiving groove and a sideway opening through which the second part of the rope can sideways enter the rope receiving groove to be releasably locked therein and can be released by being pulled out sideways therefrom, said rope receiving groove having a set of inclined keyway wedging elements (4'') to releasably engage the second part (2''') of the rope when it is in the rope receiving groove and disengage and release the second part (2''') of the rope when it is pulled sideways and outwardly from said rope-receiving groove, wherein an opposite side of said locking device (4) is attached to the first part (2') of the rope between the direction reversal means and the handle loop, whereby the locking device (4) is cooperable with the second part (2''') of the rope to provide said releasable engagement between the locking device (4) and the second part (2''') of the rope;

wherein said rope locking device is separate and spaced from said direction reversal means and can be translated along said rope while said direction reversal means remains fixed.

2. An apparatus as disclosed in claim 1, wherein the first part (2') of the rope is attached to the locking device (4) by a retaining slot (5) on the locking device (4).

3. An apparatus as disclosed in claim 1, wherein the first part (2') of the rope is attached to the locking device (4) by a clamp (5') on the locking device (4).

4. An apparatus as disclosed in claim 1, wherein the locking device (4) has a guide (7; 8) for the second part of the rope, which covers at least a portion of the sideway opening of the locking device (4), to limit movement of the second part (2''') of the rope sideways out of said rope receiving groove in the locking device (4) when the second part (2''') of the rope is pulled sideways and outwardly from said rope receiving groove to release the second part of the rope from a locked engagement position in said rope receiving groove in order to readjust the engagement position of the locking device (4) on the second part (2''') of the rope.

5. An apparatus as disclosed in claim 4, wherein the guide (7) is an elastically yielding belt.

6. An apparatus as disclosed in claim 4, wherein the guide (8) is a flap which is pivotal against spring force relative to the locking device (4).

7. An apparatus as disclosed in claim 4, wherein the locking device (4) has an upper end and a guide pin (6) at the upper end above said rope receiving groove and said inclined keyway wedging elements to limit sideways and outwardly directed movement of the second part (2''') of the rope relative to the rope receiving groove when the second part (2''') of the rope is in the locking device (4) at said one side.

8. An apparatus as disclosed in claim 7, wherein at said upper end there is a space between the guide pin (6) and a part of the locking device having said rope receiving groove and said inclined keyway wedging elements, said space being configured for transverse insertion of the second part (2''') of the rope into engagement with the locking device, and wherein said guide (7; 8) is configured to at least partly cover said space subsequent to said insertion.

9. An apparatus as disclosed in claim 8, wherein the guide (8) is a pivotable flap which has a pivot (21) at the location of said guide pin.

10. An apparatus as disclosed in claim 8, wherein the guide (7) is an elastically yielding belt.

11. An apparatus as disclosed in claim 7, wherein the guide (8) is a pivotable flap having pivot (21) at the location of said guide pin (6).

12. An apparatus as disclosed in claim 7, wherein the guide (7) is an elastically yielding belt.

13. A training apparatus consisting of a direction reversal means (1), suspendable from a fixed support and having two sides, a rope (2) which is passed via the suspended direction reversal means (1), a first part (2') of the rope being arranged to hang down from one side of the direction reversal means and having a lower end, a handle loop (2'') being provided at the lower end of the first part (2') of the rope, and a second part (2''') of the rope being arranged to hang down from the other side of the direction reversal means, wherein the apparatus has a rope locking device (4) with two opposite sides, one of said sides having a rope receiving groove and a sideway opening through which the second part of the rope can sideways enter the rope receiving groove to be releasably locked therein and can be released by being pulled out sideways therefrom, said rope receiving groove having a set of inclined keyway wedging elements (4'') to releasably engage the second part (2''') of the rope when it is in the rope receiving groove and disengage and release the second part (2''') of the rope when it is pulled sideways and outwardly from said rope-receiving groove, wherein an opposite side of said locking device (4) is attached to the first part (2') of the rope between the direction reversal means and the handle loop, whereby the locking device (4) is cooperable with the second part (2''') of the rope to provide said releasable engagement between the locking device (4) and the second part (2''') of the rope wherein the direction reversal means is a suspension bracket in the form of a U-shaped structure (13), wherein the arms (13, 13') of the U are hooked at their respective free ends; wherein a distance between the arms (13, 13') of the U-shaped bracket is adjustable for suspension from the architraves (12, 12') of an upper door frame of a door; and wherein the two arms each have a perforated portion (13''') for the rope (2) for the purpose of forming said direction reversal means.

* * * * *